US005546871A

United States Patent [19]

Chapman

[11] Patent Number: 5,546,871

[45] Date of Patent: Aug. 20, 1996

[54] PALLET SYSTEM WHEREIN AN ARRAY OF VERTICAL SOCKETS MATE WITH MODULE SIDE ELEMENTS

[75] Inventor: Leslie J. Chapman, Alresford, United Kingdom

[73] Assignee: KHS Group Limited, Alton, United Kingdom

[21] Appl. No.: 367,250

[22] PCT Filed: Jul. 16, 1993

[86] PCT No.: PCT/GB93/01507

§ 371 Date: Jan. 12, 1995

§ 102(e) Date: Jan. 12, 1995

[87] PCT Pub. No.: WO94/02367

PCT Pub. Date: Feb. 3, 1994

[30] Foreign Application Priority Data

Jul. 16, 1992 [GB] United Kingdom ..... 9215135

[51] Int. Cl.[6] ..... B65D 19/30

[52] U.S. Cl. ..... 108/54.1; 108/55.1

[58] Field of Search ..... 108/54.1, 55.1, 108/56.1, 51.1, 53.1; 206/386, 600

[56] References Cited

U.S. PATENT DOCUMENTS

| | | | |
|---|---|---|---|
| 3,307,504 | 3/1967 | Cloyd et al. | 108/56.1 |
| 3,762,343 | 10/1973 | Thacker | 108/55.1 X |
| 4,186,667 | 2/1980 | Seabrook | 108/54.1 X |
| 4,694,962 | 9/1987 | Taub | 108/54.1 X |
| 5,267,516 | 12/1993 | Abrahamson et al. | 108/54.1 X |

FOREIGN PATENT DOCUMENTS

| | | | |
|---|---|---|---|
| 214853 | 4/1961 | Austria | 108/55.1 |
| 1484463 | 6/1967 | France | 108/56.1 |
| 1149811 | 4/1969 | United Kingdom | 108/54.1 |

*Primary Examiner*—José V. Chen

*Attorney, Agent, or Firm*—Jacobson, Price, Holman & Stern, PLLC

[57] ABSTRACT

A pallet system includes a modular base element providing a horizontal supporting surface (17) and, at each corner, an array of vertical sockets (6, 7, 8) and a plurality of modular side elements having uprights (20, 21) arranged to mate with the sockets of the base element in order to stand vertically at a horizontal edge of the latter, the side elements being capable of being assembled with the base in either of two relatively horizontally displaced positions in one of which a vertical edge (24) thereof can engage and locate an upright (20) of a similar element assembled to an adjacent horizontal edge of the same base element, to form a corner, and in the other of which the vertical edge (24) can engage and locate an upright (20) of a similar element assembled to an adjacent horizontal edge of another base element mating with the first, to form an extended coplanar vertical wall.

12 Claims, 3 Drawing Sheets

Figure 1:
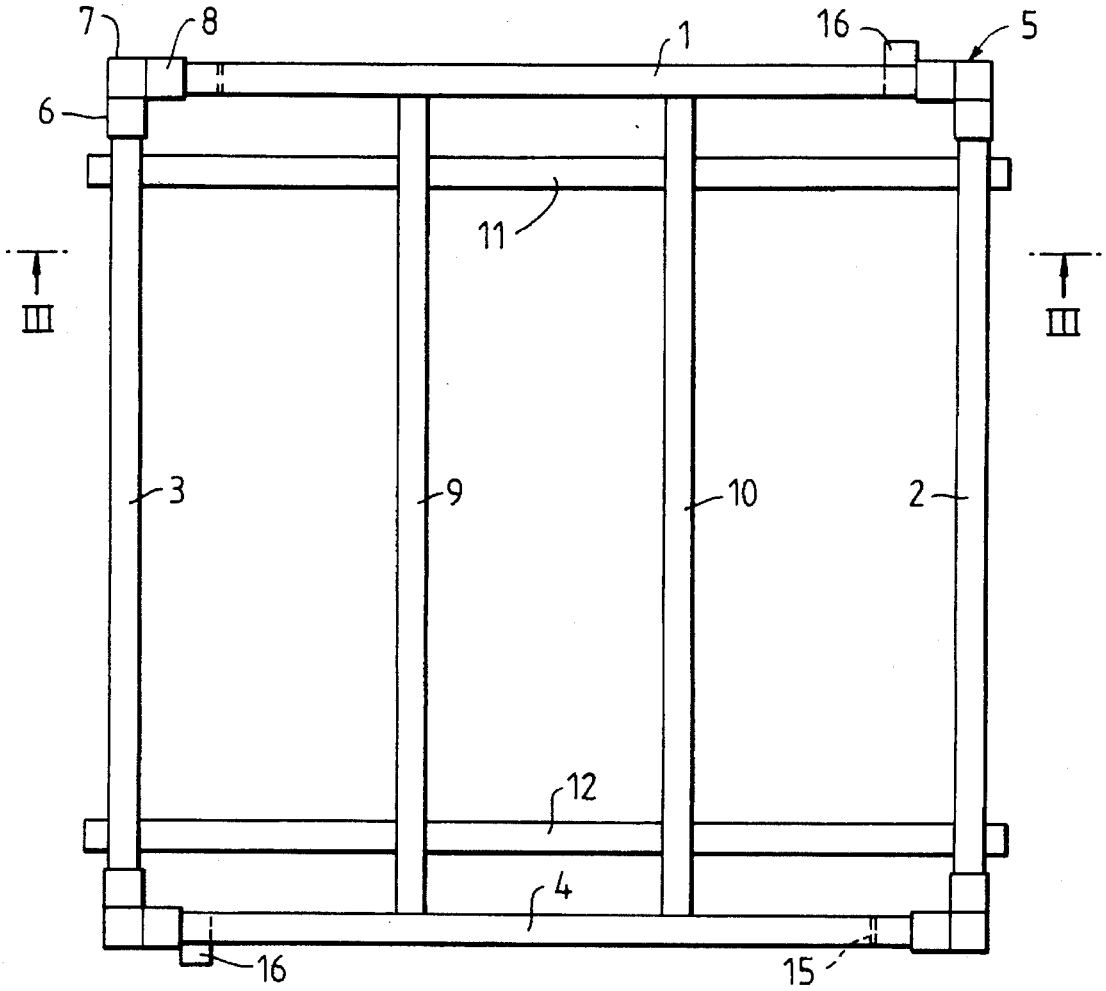

PALLET SYSTEM WHEREIN AN ARRAY OF VERTICAL SOCKETS MATE WITH MODULE SIDE ELEMENTS

This invention concerns a pallet, and more particularly a pallet of the kind comprising a pallet base providing a supporting surface with an entry space therebelow to receive the fork of a fork lift truck, and side members that are attachable to the base to enclose goods supported thereon and to allow loaded pallets to be stacked one above the other.

It is an object of the invention to provide a pallet system comprising base and sides that are of modular construction enabling simplified assembly of the pallet from few standard parts.

Further preferred objects of the invention, not necessarily in order of importance, are as follows:

1. The pallet should provide for two way, or optionally four way, entry.
2. Two pallet bases should couple together to form a double pallet, when required.
3. The pallets should be capable of being stacked at least two high when assembled and loaded, either singly or when coupled in pairs.
4. The modular system should be inherently incapable of being assembled with more than two pallet bases linked together.
5. The side members should optionally enclose either two opposite sides, or both sides and ends, of a single or double pallet base.
6. The modular pallet system should comprise only two different components, namely the pallet base and a standard side member.

According to one aspect of the invention, a pallet system comprises a pallet base providing a horizontal supporting surface of generally rectangular, preferably square, outline and having an array of vertically aligned connecting means at each corner, and a plurality of side members each including a pair of uprights arranged to mate with corresponding connecting means of said arrays at two corners of the base, one upright of each pair including locating means for embracing the other upright of another side member in order to maintain relative alignment of the uprights in a horizontal direction.

According to another aspect of the invention, there is provided a pallet system including a modular base element providing a horizontal supporting surface and arranged to mate with a similar element at one horizontal edge, by interengagement along a horizontal axis, and a modular side element arranged to mate with the base element in order to stand vertically at a horizontal edge thereof, the side element being capable of being assembled with the base in either of two relatively horizontally displaced positions in one of which a vertical edge thereof can engage and locate a corresponding vertical edge of a similar element assembled to an adjacent horizontal edge of the same base element, to form a corner, and in the other of which a vertical edge thereof can engage and locate a corresponding vertical edge of a similar element assembled to an adjacent horizontal edge of another base element mating with the first, to form an extended coplanar vertical wall.

Figure 2:
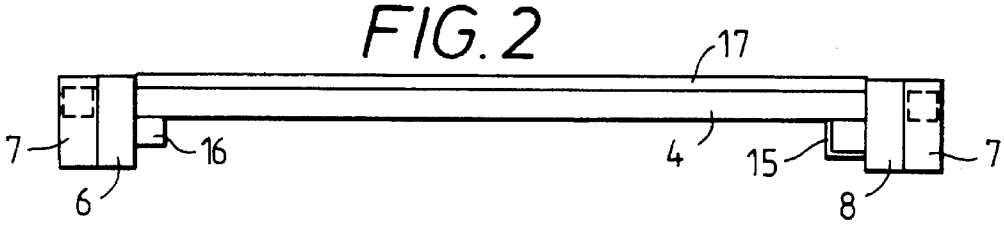
Figure 3:
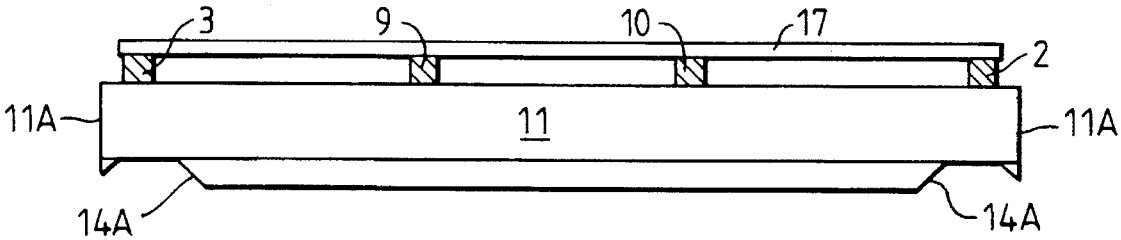
Figure 4:
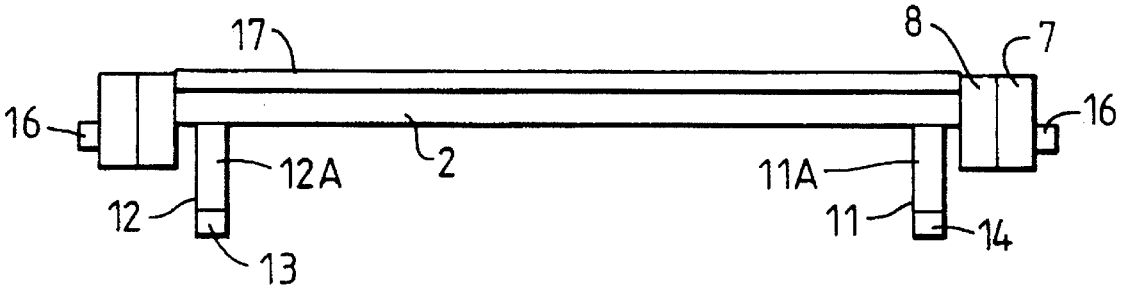
Figure 5A:
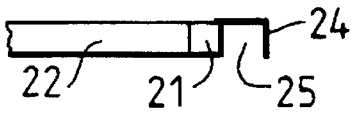
Figure 5:
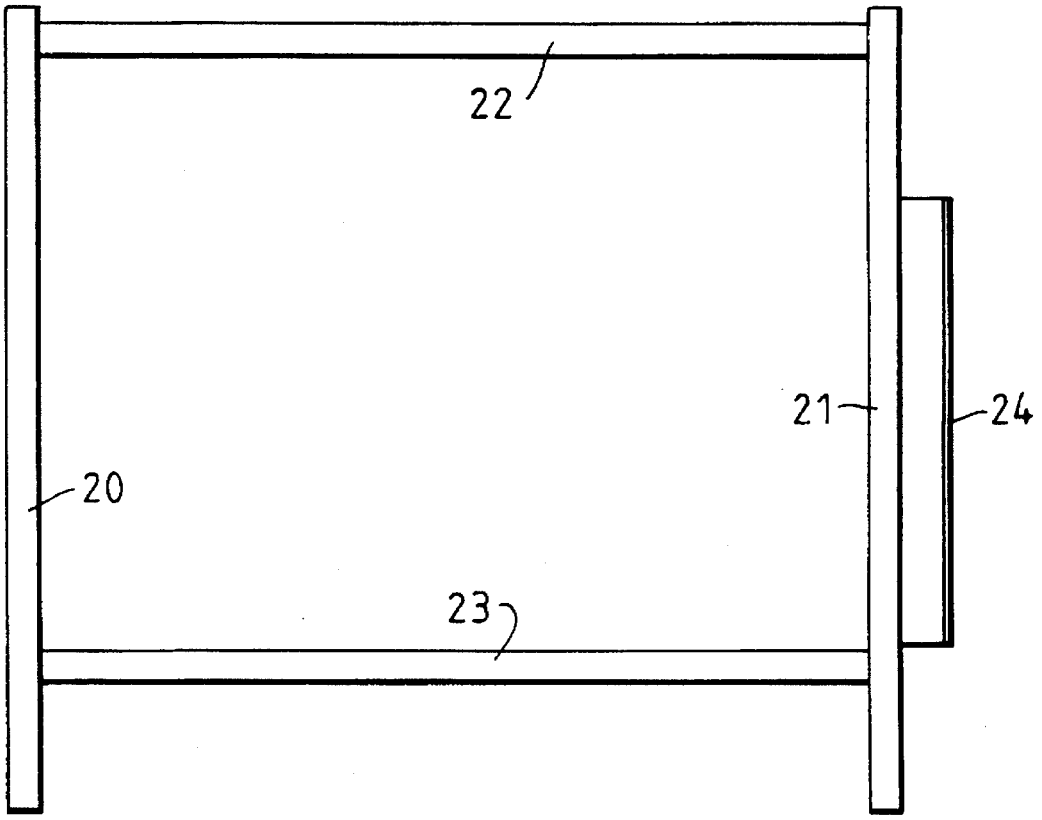
Figure 6:
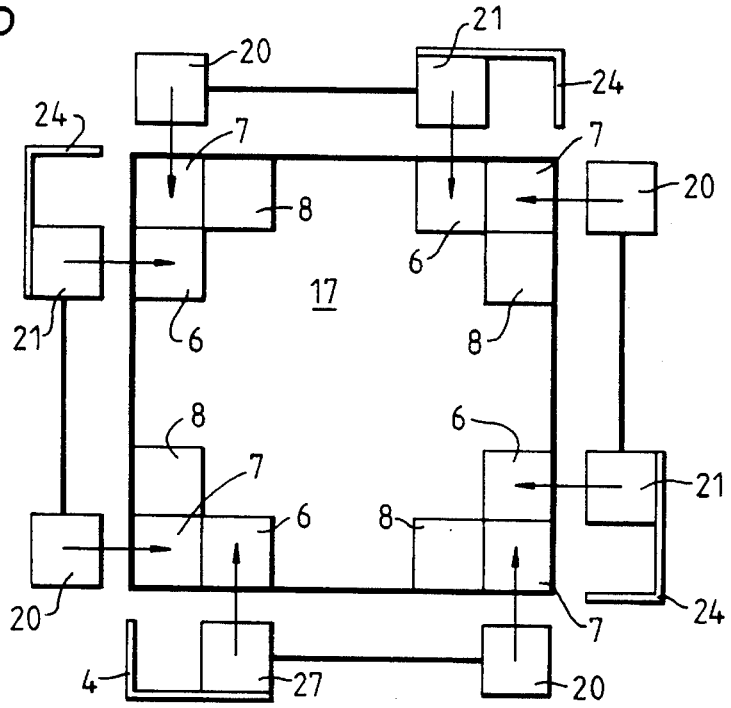
Figure 7:
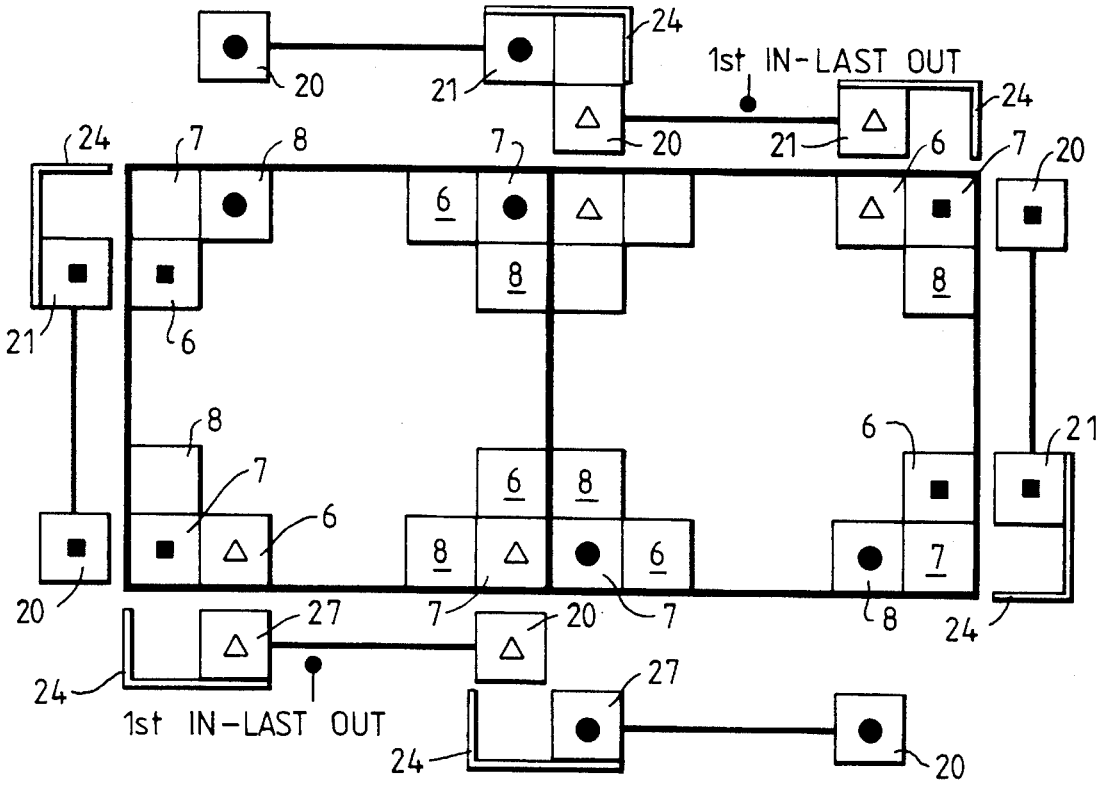

Further preferred features of the invention relevant to the preferred objects will become apparent from the following description and the drawings, in which:

FIG. 1 is a plan view of the base of a pallet in accordance with the invention, shown with the top surface removed to expose the frame work, FIG. 2 is a side elevation of the pallet of FIG. 1, taken from the bottom of the drawing as viewed in FIG. 1, shown with lower supporting cross members omitted for clarity, FIG. 3 is a sectional elevation on the line III—III of FIG. 1 showing the lower cross members omitted from FIG. 2, FIG. 4 is a side elevation of the pallet base of FIG. 1 viewed from the right hand side of the drawing as shown in FIG. 1, FIG. 5 is a side elevation of a side member for use with the base of FIG. 1, FIG. 5A is a fragmentary plan view of the side member of FIG. 4, FIG. 6 is a diagram illustrating the assembly of base and side units to form a single enclosed pallet, and FIG. 7 is a diagram illustrating the assembly of bases and side members as shown in FIGS. 1 to 5, to form an enclosed double pallet.

Referring to FIGS. 1 to 4 of the drawings, a pallet base comprises a generally square frame formed by side members 1 to 4 of steel section, typically tube, the ends of which are welded to corner angle pieces 5 each of which comprises three sections 6, 7, and 8 of steel tube of square cross-section, welded together and extending vertically.

Two opposite side members 1 and 4 are interconnected by cross-members 9 and 10 also of steel section, and two further cross-members 11 and 12 of steel section are in turn welded below the side members 2 and 3 and cross members 9 and 10, to extend downwardly as illustrated more clearly in FIGS. 3 and 4.

Below the sections 11 and 12 are welded further sections 13 and 14, the ends of which are chamfered as indicated at 14*a* in FIG. 3. The ends of sections 11 and 12 are closed by portions of steel plate 11A and 12A that are angled to form a downwardly extending lip complementing the chamfer 14A or 13A to provide an angled recess at the underside of the sections 11 and 12.

As shown in FIG. 2, there is welded into the angle between the side member 4 and the adjacent section 8, a short angle section 15 that forms a horizontally extending female socket terminating flush with the vertical edge of the section 4. In a similar manner there is welded between the angle of the section 4 and the section 6 a horizontally extending section of square steel tube 16, that extends laterally away from the side member 4 to form a spigot. A corresponding socket 15 is provided in the angle between the side member 1 and the adjacent section 8, whereas a corresponding spigot 16 is provided in the angle between the side member 1 and the adjacent section 6. The dimensions of the respective sections are such that spigots 16 will mate with sockets 15.

As shown in FIGS. 2 to 4, the horizontal framework illustrated in FIG. 1 serves to support a panel 17 the corners of which are shaped to fit within the angle pieces 5 leaving the open ends of the steel sections 6, 7, and 8 free.

Referring to FIGS. 5 and 5*a*, there is illustrated a side member for assembly with the base of FIGS. 1 to 4. The side member comprises two vertical uprights 20 and 21 interconnected by upper and lower side rails 22, 23. The space between the uprights 20 and 21 and the side rails 22 and 23 may be filled by an appropriate panel of, for example, wire mesh, to contain the contents of the pallet. The upright 21 has welded thereto a metal section of L-shaped cross-section 24, which, as shown more clearly in FIG. 5*a* defines a recess 25 capable of embracing an upright 20 of another identical side member, as will be described in more detail below.

FIG. 6 shows diagrammatically the assembly of a base unit as illustrated in FIGS. 1 to 4 with four identical side members as shown in FIG. 5 to form an enclosed pallet. The reference numerals correspond to the components already described with reference to FIGS. 1 to 5, and it will be seen that in each case the two downwardly extending stubs of uprights 20 and 21 will fit within sockets formed by the sections 7 and 6 at each side of the base unit. Furthermore, the angle sections 24 will extend around the uprights 20 of an adjacent side member, so that the four side members interlock to form a stable side wall that is capable of supporting another similar pallet stacked thereon. It will be noted that when such pallets are stacked, the chamfered ends of the sections 13 and 14 and the angled lips of plates 11A and 12A will engage over the sections 22 of the side members of the pallet below, in order to prevent misalignment or sideways slippage of the stacked pallets.

Referring to FIG. 7, there is shown diagrammatically two base units assembled with side members to form an enclosed double pallet. Two base units are initially assembled with two side edges juxtaposed. The transverse sections 11 and 12 of each base member prevent juxtaposition of side members 2 and 3, and thus side members 1 and/or 4 of base units must be juxtaposed, in which case spigots 16 and sockets 15 interengage to prevent vertical and lateral relative sliding movement. The side members are inserted in their appropriate sockets in a similar manner to that already described above with reference to FIG. 6, with the exception that whereas the first inserted side member has the upright 20 engaging a socket 7 and the upright 21 engaging a socket 6, as in FIG. 6, the next side member that forms the long wall of the double unit is inserted with the upright 20 in the socket 8 and the upright 21 in the socket 7, so that the angle section 24 embraces the upright 20 of the adjacent side member. This arrangement serves both to retain the spigots 16 and sockets 15 in engagement with one another and to prevent the double base unit thus formed from breaking its back when lifted under load. It should further be appreciated that this method of assembly inherently prevents more than two base units from being assembled together, since even if three base units are connected together end-to-end by means of the spigots 16 and sockets 15, only two adjacent side members are capable of being inserted in the available sockets 6, 7, 8.

It will be appreciated from the above disclosure that an arrangement in accordance with the invention provides a novel pallet system that is of simple and versatile construction while being light in weight and requiring the stockage of only two different modules.

Whereas a preferred embodiment of the invention has been described above, it will be appreciated that various modifications may be made thereto without departing from the scope of the invention as defined in the appended claims. For example although the above description relates to a double entry pallet the same arrangement may be applied to a four way entry pallet by omitting the support members 11 and 12 and providing equivalent supporting members extending below and parallel to the sections 2 and 3. Such members should terminate at a spacing from the corner members 5 to provide the four way entry and should extend laterally beyond the sides of members 2 and 3 to prevent the juxtaposition of these sides in the assembly of a double pallet.

I claim:

1. A pallet system comprising a base element providing a horizontal supporting surface of generally rectangular outline, first and second connecting means provided at each corner of said surface and arranged to extend normally thereto, and four side enclosure elements each including first and second uprights arranged to mate respectively with a first connecting means at one corner of the base element and a second connecting means at an adjacent corner thereof, whereby said enclosure element stands upright along an edge of said surface between said adjacent corners, each said first upright including locating means for embracing a second upright of another side enclosure element at said one corner in order to maintain relative alignment of the uprights in a horizontal direction, whereby said four enclosure elements interlink to form an enclosure bounding said supporting surface and providing at an upper edge of the enclosure support for a base element of another pallet system.

2. A pallet system according to claim 1, wherein said base element and each side element have a framework formed of steel section, the said connecting means comprising sections that are vertically aligned to form sockets and the said uprights comprising frame members that are extended to form complementary spigots.

3. A pallet system according to claim 2, wherein one of said frame members of each side element has attached thereto a bracket of L-section defining a recess for embracing the other frame member of another side element assembled adjacent thereto.

4. A pallet system as claimed in claim 2, wherein the frame of the base element is provided with a load bearing cover panel that is arranged to rest thereon and to be located between upper extremities of said sockets.

5. A pallet system as claimed in claim 1, wherein the generally rectangular outline is a square outline.

6. A pallet system including at least two modular base elements each providing a horizontal rectangular supporting surface defined by four horizontal edges and arranged to mate with another one of said base elements at a first one of said horizontal edges, by interengagement along a horizontal axis, and at least four modular side elements each arranged to mate with receiving means provided at each of said four horizontal edges of each base element in order to stand vertically at a said horizontal edge thereof, each side element having first and second vertical edges, each first vertical edge being provided with means for engaging and locating a second vertical edge of another side element said receiving means at opposed second and third horizontal edges of each said base being arranged to receive a said side element in either of two relatively horizontally displaced positions in one of which said engaging means at said first vertical edge thereof can engage and locate a second vertical edge of another side element mating with said receiving means at said first horizontal edge of said base element, to form a corner, and in the other of which said engaging means at said first vertical edge thereof is adapted to engage and locate a second vertical edge of a side element mating with said receiving means at a third or second horizontal edge of another base element mating with the first horizontal edge of said base element, to form an extended coplanar vertical wall.

7. A pallet system comprising a base element providing a horizontal supporting surface of generally rectangular outline and having an array of vertically aligned connecting means at each corner including a first connecting means arranged at an apex of each corner and second and third connecting means respectively on first and second sides of each corner adjacent the first connecting means, and a plurality of side elements, each including a pair of uprights arranged to mate with corresponding connecting means of said arrays at two adjacent corners of the base element, one upright of each pair including locating means for embracing the other upright of another side element in order to maintain relative alignment of the uprights in a horizontal direction and wherein said two uprights are so spaced that with one upright mating with a first connecting means at one corner of the base, the other upright mates with that one of the second and third connecting means at an adjacent corner that lies between the said one corner and the said adjacent corner.

8. A pallet system according to claim 7, wherein said base element and each side element have a framework formed of steel section, the said connecting means comprising sections that are vertically aligned to form sockets and the said uprights comprising frame members that are extended to form complementary spigots.

9. A pallet system according to claim 8, wherein one of said frame members of each side element has attached thereto a bracket of L-section defining a recess for embracing the other frame member of another side element assembled adjacent thereto.

10. A pallet system as claimed in claim 9, wherein the framework of the base element has horizontally extending spigot means and horizontally extending socket means provided at said first horizontal edge and arranged for mating engagement with socket means and spigot means at a said first horizontal edge of another identical base element.

11. A pallet system as claimed in claim 8, wherein the frame of the base element is provided with a load bearing cover panel that is arranged to rest thereon and to be located between upper extremities of said sockets.

12. A pallet system as claimed in claim 7, wherein the generally rectangular outline is a square outline.

* * * * *